US005566926A

United States Patent [19]

Voigt

[11] Patent Number: 5,566,926

[45] Date of Patent: Oct. 22, 1996

[54] RESILIENT SAFETY BARRIER

[75] Inventor: William L. Voigt, Bermuda Run, N.C.

[73] Assignee: Voight Products Incorporated, Bermuda Run, N.C.

[21] Appl. No.: 444,148

[22] Filed: May 18, 1995

Related U.S. Application Data

[63] Continuation-in-part of Ser. No. 292,855, Aug. 19, 1994, Pat. No. 5,468,093.

[51] Int. Cl.[6] ..... E04H 17/14

[52] U.S. Cl. ..... 256/13.1; 256/65; 256/68; 256/69; 256/70; 403/225; 403/227; 404/6

[58] Field of Search ..... 404/6, 9–13; 256/1, 256/13.1, 65–72, DIG. 5, DIG. 6, 19, 59; 248/158, 160; 403/220, 221, 223, 224, 225, 226, 227, 228

[56] References Cited

U.S. PATENT DOCUMENTS

| | | | |
|---|---|---|---|
| 2,856,215 | 10/1958 | Schlosser et al. | 256/65 X |
| 3,713,611 | 10/1973 | Voigt | 248/160 X |
| 3,804,542 | 4/1974 | Hammerschmidt | 256/65 X |
| 4,208,037 | 6/1980 | Le Gal | 403/223 X |
| 4,533,121 | 8/1985 | Basey | 256/59 X |
| 4,557,449 | 12/1985 | Davidson et al. | 248/160 |
| 4,898,365 | 2/1990 | Conner et al. | 256/22 X |
| 4,952,092 | 8/1990 | Ballerstein | 256/65 X |
| 5,354,037 | 10/1994 | Venegas, Jr. | 256/65 X |

FOREIGN PATENT DOCUMENTS

| | | | |
|---|---|---|---|
| 2260550 | 4/1993 | United Kingdom | 256/59 |

*Primary Examiner*—James A. Lisehora

*Attorney, Agent, or Firm*—William G. Dosse; Moore & Van Allen, PLLC

[57] ABSTRACT

A resilient mounting system for safety barriers, including guardrails, hand rails, etc., includes a urethane rubber or other resilient material substantially between the periphery of the barrier and a floor or base. The barrier is biased against the base so as to provide an stiff yet resilient impact resistance that yields to absorb the energy of impact, such as from a vehicle, rather than requiring the structural material of the barrier itself to absorb and perhaps become dislodged or deformed by the impact. The resilient material can be shaped generally like the periphery of the barrier or it can be a standard shape that is replicated and arranged to engage a support for the barrier. A rail is resiliently mounted between two supports, the resilient mounting being arranged to permit limited relative movement between the rail and the supports but resisting removal of the rail from the supports.

12 Claims, 5 Drawing Sheets

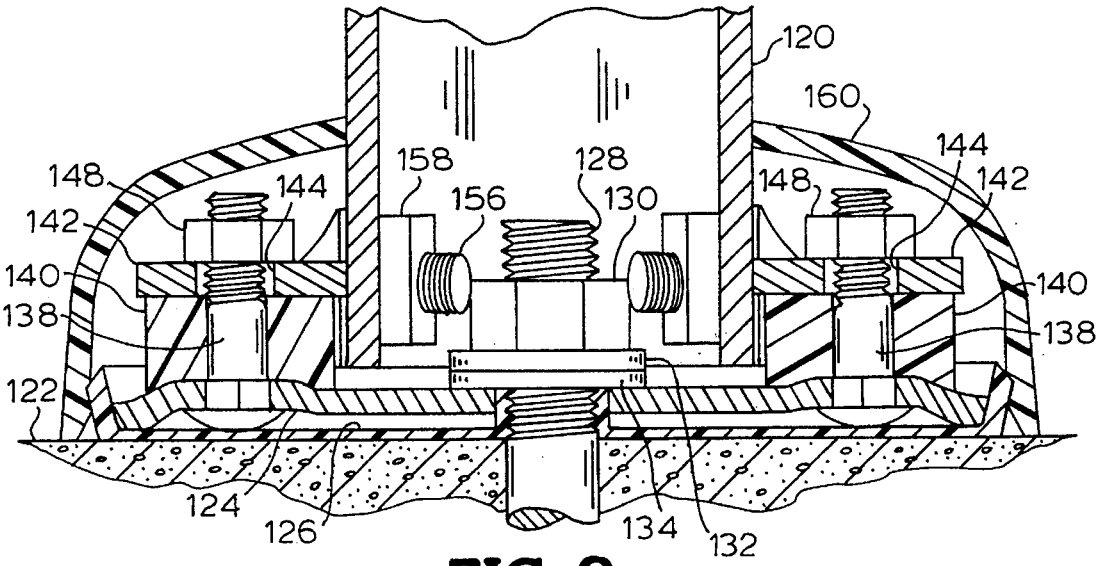
FIG. 9
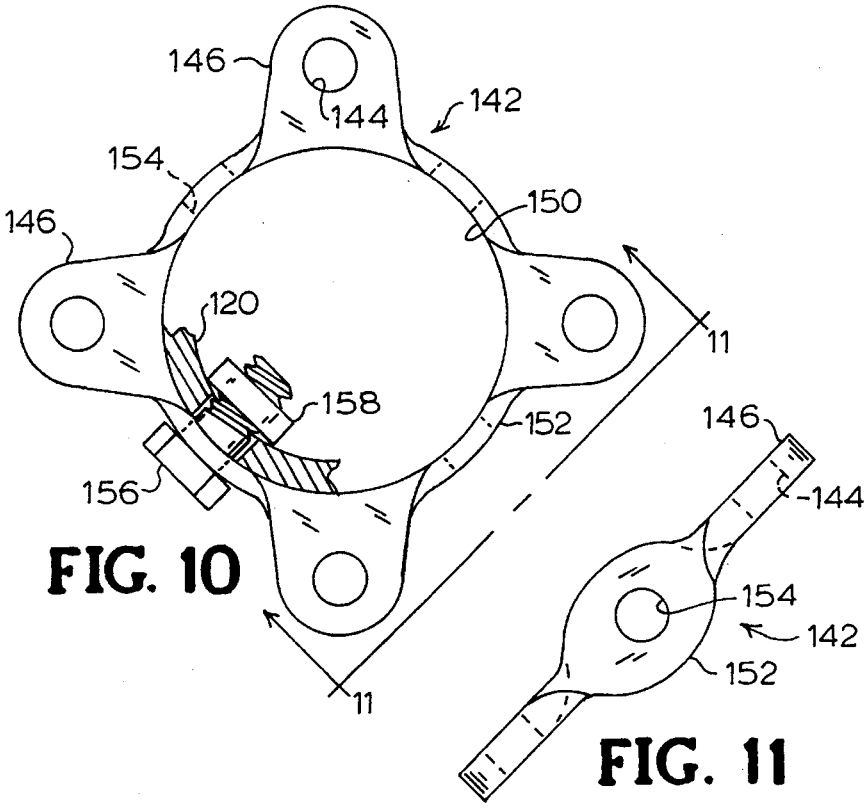
FIG. 10
FIG. 11

RESILIENT SAFETY BARRIER

RELATED U.S. APPLICATION

This Application is a Continuation-In-Part of Ser. No. 08/292,855, filed Aug. 19, 1994, now U.S. Pat. No. 5,468,093, granted Nov. 21, 1995.

FIELD OF THE INVENTION

The present invention relates generally to safety barriers, railings, and supports incorporating mountings that will absorb substantial impact without permanent deformation. More specifically, the present invention relates to barriers, railings, and supports that will, on a continuing and reliable basis, without frequent repair or replacement, protect personnel from injury and plant and facilities from damage.

BACKGROUND OF THE INVENTION

Almost every dangerous curve on a highway has some sort of a crash barrier or guardrail intended to keep an out-of-control vehicle on the highway right-of-way. After a crash, such a barrier is often sufficiently damaged to require repair in order to restore its strength to try to save the next unlucky driver.

Most factories that have indoor vehicular traffic have crash barriers to confine the vehicles to designated paths and to keep them out of areas where they are not wanted. Unless such a barrier has been exceedingly overdesigned for the weight and expected speed of the vehicles used in the factory, in time the barriers will become bent, twisted, loose from the factory floor, and otherwise deformed so as to impair their appearance and probably even impair their effectiveness.

Hand railings and other edge supports are usually placed on stairwells and ramps for the support and safety of pedestrians using those facilities. If hand trucks and perhaps larger vehicles also use those facilities, the railings, etc., must either be seriously overdesigned for pedestrian purposes or will in time become bent and deformed from impacts by the much heavier, and less yielding wheeled vehicles.

Therefore, what is needed is a low-cost barrier, guardrail, or hand railing system which can receive and shrug off, without permanent deformation, the inevitable, occasional impacts from vehicles, without the need for massive overdesign of the barrier system, while maintaining a clean and neat appearance.

SUMMARY OF THE INVENTION

The present invention contemplates a resilient safety barrier that is resiliently supported on a base of some sort comprising a barrier member with the resilient support having a perimeter calculated to resiliently support the perimeter of the barrier member, and the barrier member being biased toward the resilient support and the base, so as to allow limited, non-destructive, shock-absorbent movement of the barrier member with respect to the base.

The present invention further contemplates a resilient mounting for a barrier rail on at least two support members, with a rail member extending substantially between the two support members, a resilient material located between the rail member and each support member, so as to allow limited, non-destructive, shock-absorbent movement of the rail member relative to the support member, and with a clamp for squeezing the resilient gasket between the rail member and the support member.

BRIEF DESCRIPTION OF THE DRAWINGS

A more complete understanding of the present invention will be had from the following detailed description when considered in conjunction with the accompanying drawings, wherein the same reference numbers refer to the same or corresponding parts shown throughout the several figures, in which:

FIG. 9 is an elevational view in cross section of a lightweight, resilient post-mounting structure;

FIG. 10 is a detail view of a collar used for flexibly mounting a post, with a fragment of the post shown in cross section;

FIG. 11 is a view, taken along line 11—11 of FIG. 10;

DETAILED DESCRIPTION OF THE PREFERRED EMBODIMENT

Figure 1:
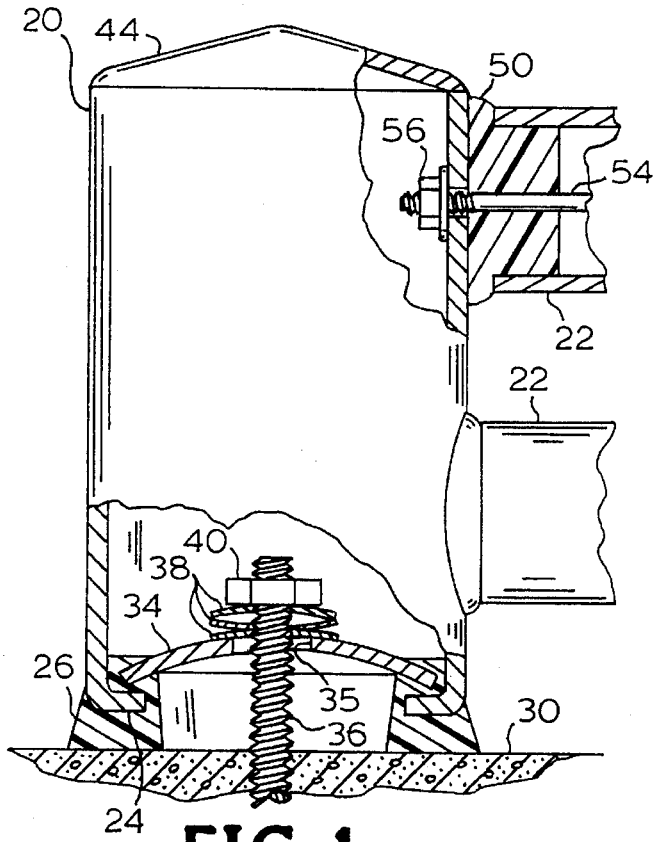
FIG. 1 is an elevation of an upright barrier member shown partially cut away in cross section to illustrate the mounting of rails to the barrier member and the resilient support on which the barrier member is mounted to a base.

Referring now to the drawings and particularly to FIG. 1, an upright, steel support member or barrier 20 of cylindrical shape is shown partially broken away in cross section. Two circular steel barrier rails or guardrails 22 are also shown, one shown in cross section. The guardrails 22 extend between the barrier 20 and another, similar barrier, not shown.

The bottom end of the upright support member or barrier 20 is preferably bent or otherwise formed inward to include a circular lip 24. A circular block 26 of an elastomer such as resilient urethane is preferably molded around the bottom end of the barrier 20 and the lip 24 with approximately the same circular shape as the barrier 20. The bottom of the urethane block is shaped flat so as to rest on a suitable base 30, usually of concrete or other paving or flooring material.

While urethane is preferred, any resilient material with advantageous mechanical properties and a strong resistance to taking a permanent set under stress can be used.

A domed steel plate 34 is preferably molded into the inside of the urethane block 26. A central hole 35 in the plate 34 accommodates a mounting bolt or stud 36 that is rigidly anchored into the base 30. The central hole 35 in the plate 34 is made slightly oversize for the stud 36, in order to allow manual adjustment of the barrier 20 and to accommodate manufacturing and installation tolerances.

While the domed plate 34 is shown molded into the inside of the urethane block 26, alternatively, a step could be formed in the inner, upper perimeter of the block 26; and the domed plate 34 could be nested into that step.

One or more (preferably three) spring washers 38 are placed around the stud 36 and on top of the plate 34. These spring washers 38 are generally dome-shaped and are compressed when, during installation of the barrier 20, a nut 40 is tightened onto the stud 36, in order resiliently to apply a substantial downward force on the plate 34 and thus hold the barrier in place. The pile-up of spring washers 38 is made by putting each spring washer in an alternating orientation as they are placed down about the stud 36.

Thus, the first spring washer 38 is placed in an orientation so that its periphery contacts the plate 34. This orientation of the first spring washer 38 has the advantage of having the periphery of the spring washer 38 extend beyond the oversize perimeter of the hole 35. The second spring washer 38 is then placed upside down with respect to the first spring washer and on top of the first spring washer, with the edge of its central aperture touching the edge of the central aperture of the first spring washer. Then the third spring washer 38 is oriented just like the first spring washer and is placed down on top of the second spring washer with the outer peripheries of the second and third spring washers in contact. In this way, the tightening of the nut 40 partially compresses the three spring washers 38 and forces or presses the plate 34 down and thus yieldably holds or biases the barrier 20 and the block 26 down to the floor or base 30.

If the base 30 is slightly uneven, such that the barrier 20 would stand tipped slightly to one side, the installer can move the barrier toward the lower side of the base 30, using some of the oversize diameter space allowed in the hole 35 through which the stud 36 extends. Then, when the nut 40 is tightened, the downward pressure is applied more strongly on the uppermost or higher side of the urethane block 26. That tends to compress the higher side of the urethane block 26 more than its lower side. That differential compression of the urethane block 26 tends to straighten the barrier 20, bringing it into a more vertical or plumb condition.

The barrier 20 is preferably made from a length of common steel pipe of sufficient diameter and thickness to do the job. It is preferred that a standard, stock size of pipe be used and cut to the desired length. Therefore, preferably, the upright barrier 20 is open at the top in order to provide access to the inside of the barrier for on-site assembly and installation. However, the barrier 20 should preferably be capped for safety and cleanliness, as a final step in the on-site assembly process.

Figure 4:
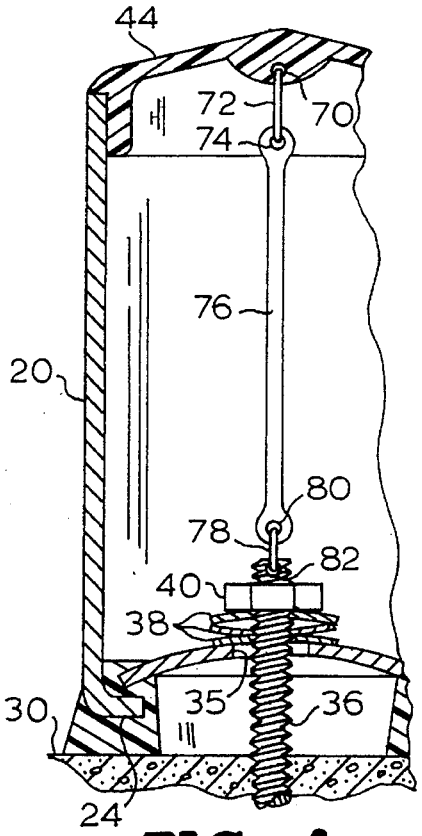
FIG. 4 is a partial view, in cross section, of the barrier member of FIG. 1 but showing a top resiliently held onto the barrier member.
Figure 5:
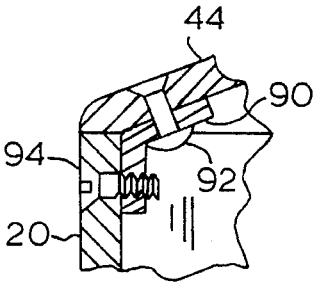
FIG. 5 is a detail, in cross section, of an alternative top held in an alternative manner to the barrier member.

Preferably, a cap 44 of pressed steel, molded thermoplastic rubber or any other crack-resistant, sturdy material can be mounted on the top of the upright support member or barrier 20 in order to protect anyone casually touching the barrier and to keep out dirt and moisture. Any removable mounting can be used for the cap 44. FIGS. 4 and 5 show two preferred mountings for a cap 44 and will be explained in greater detail hereinafter.

If the barrier 20 is struck by a vehicle, it will yield under the impact. The steel barrier cylinder 20 will not noticeably BEND under the impact so much as the barrier cylinder 20 will ROCK and squeeze the far side of the resilient, elastomeric urethane block 26, which will act as a high-hysteresis spring and absorb the energy of impact. The spring washers 38 will also yield slightly as the plate 34 rocks, so as to accommodate the selective squeezing of the block 26 that results from an impact. All of this is calculated to let the barrier resist the impact but yet yield under the impact without permanent deformation.

The barrier 20 can be either painted, galvanized, electroplated, or covered by slipping a molded plastic cover over it, in order to reduce rust and defacing of its surface that would inevitably result from numerous impacts from vehicles.

The barrier 20 can stand alone to protect a corner or can be one of many vertical barriers used to protect a wall or line. Alternatively, the barrier 20 can be linked to another barrier, not shown, by a pair of guardrails 22 which provide a continuous barrier to traffic and thus protect a wall or line without necessitating an unreasonable number of individual vertical barriers.

The guardrails 22 can also be resiliently mounted to the barrier 20, as shown in FIG. 1. Preferably, the guardrails 22 are made of circular steel pipe of standard, off-the-shelf size and wall thickness. A stepped urethane gasket or plug 50 is slipped into each end (only one end shown) of the guardrail 22. Each plug 50 has a central hole which accommodates a rod or shaft 54, which extends into the interior of the barrier 20. The shaft 54 has threads at least at each end thereof for cooperating with a nut 56 which pulls on the two barriers 20 that support the ends of the guardrail 22 and compresses the gasket or plug 50 at each end of the guardrail 22.

The on-site installation of the barrier 20 and guardrails 22 (if fitted to the barrier 20) can preferably be done with the cap 44 off of the cylindrical barrier 20 and then mounted on the barrier 20 as one of the final steps in the on-site installation. Therefore, all of the internal assembly, such as tightening the nuts 40 and 56, can be done through the open top of the barrier 20, before the cap 44 is installed.

Alternatively, but not preferred, the cap 44 can be either integrally formed with the cylindrical barrier 20 or can be welded to the cylindrical barrier 20 at the factory and preferably not welded on site but possibly welded on site. If the cap 44 is an integral part of the barrier 20, either by integral forming or by welding, as it is delivered to the installation site, access should be provided for tightening the installation nuts 40 and 56 on site. Therefore, an access opening (not shown) can be provided on the side of the barrier 20 opposite from the expected impacts, with machine screw or other fasteners for closing the door of the access opening.

When a guardrail 22 is struck by a vehicle, not only does the upright support member or barrier 20 yield under the impact, by reason of the block 26; but the gasket or plug 50 also yields slightly in order further to absorb the energy of impact.

ALTERNATIVES

Figure 2:
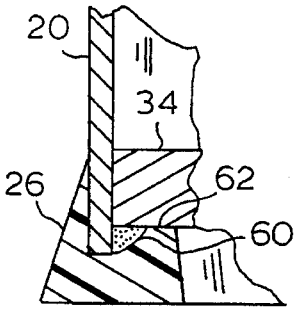
FIG. 2 is an alternative arrangement for mounting the barrier member to the resilient support.

Referring now to FIG. 2, if production volume is not adequate to justify tooling to form the lip 24 at the lower end of the barrier 20, the plate 34 can be welded, for example at a weld bead 60, onto the inside of the bottom or lower end of the barrier 20. The plate 34 can be a flat circle and need not be domed. Also, the weld bead 60 can be either on the top or on the bottom of the plate 34, although the bottom might be easier and thus cheaper. Without the need to mold the lip 24 and the plate 34 (FIG. 1) into the urethane block 26, the urethane block 26 can be cut and minimally shaped from flat, but thick, urethane stock. The base 26 can be cut with a shelf 62 to support the plate 34 and the barrier 20 and to accommodate the weld bead 60, if necessary. The bottom end of the barrier 20, together with the perimeter of the plate 34 and perhaps also with the weld bead 60, thus also constitutes a shelf which rests on the shelf 62 that is formed on the resilient mounting support or block 26.

Figure 3:
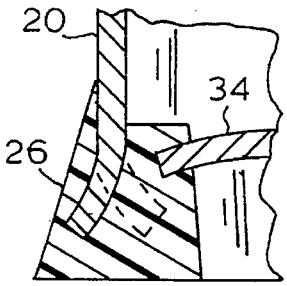
FIG. 3 is another alternative arrangement for mounting the barrier member to the resilient support.

Referring now to FIG. 3, if production volume is adequate to justify significant tooling, the lip 24 at the bottom of the barrier 20 can be formed into a plurality of lips 24 bent in alternate directions around the periphery of the bottom end of the barrier 20, much like the teeth of a saw are "set" to alternate sides of the blade.

Referring now to FIG. 4, the center and one side of the barrier 20 are shown in cross section with an example of a molded cap 44 of thermoplastic rubber. In order to removably hold the cap 44 in place on top of the barrier 20, a hole 70 is preferably formed in a web or boss on the inside of the cap 44. A hook or a cut or "jump" ring 72 (not shown in cross section, for clarity) is passed through the hole 70 and preferably through a hole 74 in the top end of a resilient rubber tarp strap or "bungee" strap 76. Another hook or jump ring 78 is passed through a hole 80 at the bottom end of the resilient strap 76 and through a hole 82 formed near the top end of the stud 36. Alternatively, a loop or an eye can be formed at the top end of the stud 36 or can be welded, screwed on, or otherwise formed on the top of the nut 40.

If a hook or a cut or jump ring 72 and 78 is cut or open at one point in its circumference, the entire load that it carries resolves to a bending stress that is at a peak on the side of the ring opposite from the cut. Therefore, the rings 72 and 78 should be designed accordingly. Such cut or jump rings are commonly used, albeit on a much smaller size scale, in the jewelry art. The hooks or jump rings 72 and 78 can be installed on site or can be factory installed with the last connection to the hole 82 being done on site. It will be evident to one skilled in the art that there are any number of alternate ways resiliently to hold the cap 44 to the barrier 20.

FIG. 5 shows, in fragmentary cross section, an alternate cap 44, in the form of a steel dome, and means for holding it in place. A plurality of angle irons 90 are riveted around the inside edge of the cap 44 in the factory using rivets 92 having flat, recessed heads in countersunk holes on the exposed surface of the cap 44. The other arm of each angle iron 90 has a threaded hole. Flat-head machine screws 94 extend through countersunk holes around the top end of the barrier 20 to fasten the angle irons 90 and thus the cap 44 to the top end of the barrier 20.

Figure 6:
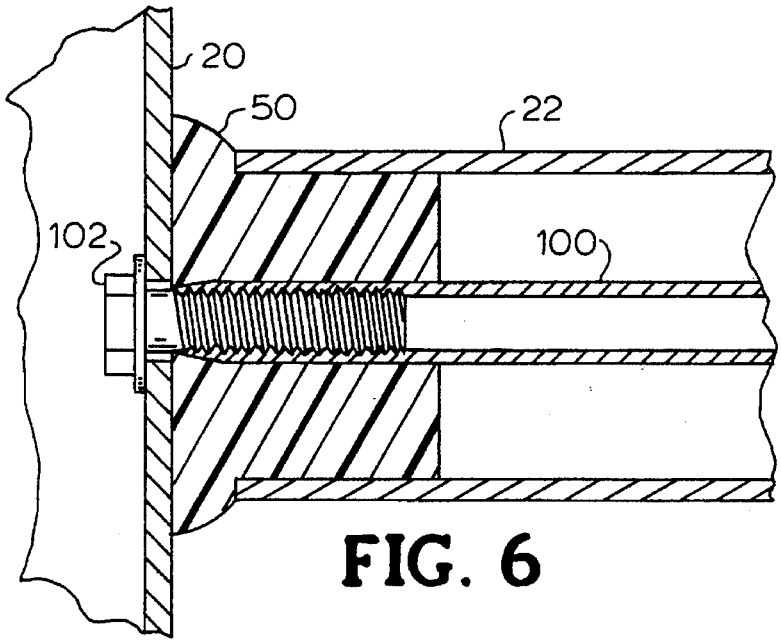
FIG. 6 is a partial cross sectional view showing one way to hold a rail to the barrier member.

FIG. 6 shows in cross section an alternate embodiment of the end treatment of the guardrail 22. Instead of the rod or shaft 54 (FIG. 1) with threaded ends and a nut 56 to tension the shaft 54, a larger central hole is formed in the gasket or plug 50 and a pipe or tube 100—the functional and structural equivalent of the rod or shaft 54—passes through the plug 50. With a tube 100 of larger diameter than the shaft 54, significantly higher friction can be achieved between the plug 50 and the tube 100 than is possible with the shaft 54. Therefore, it is more feasible to preassemble at the factory a plug 50 in each end of the guardrail 22 with the tube 100 firmly pressed into both plugs to hold them tightly in place. That subassembly can then be shipped to the assembly or job site with little fear that it will fall apart. The tube 100 is preferably on the order of a steel water pipe with either a galvanized or black oxided finish and internal threads formed at each end.

Consequently, at the assembly or job site, the guardrail 22 subassembly is placed into position between two barriers 20 and a bolt 102 is inserted through a hole in each barrier and threaded into each internally threaded end of the tube 100. In this way, the two barriers 20 don't have to be forced apart to allow the insertion of the ends of the shaft 54, which must be a bit longer than the distance between adjacent barriers.

Figure 7:
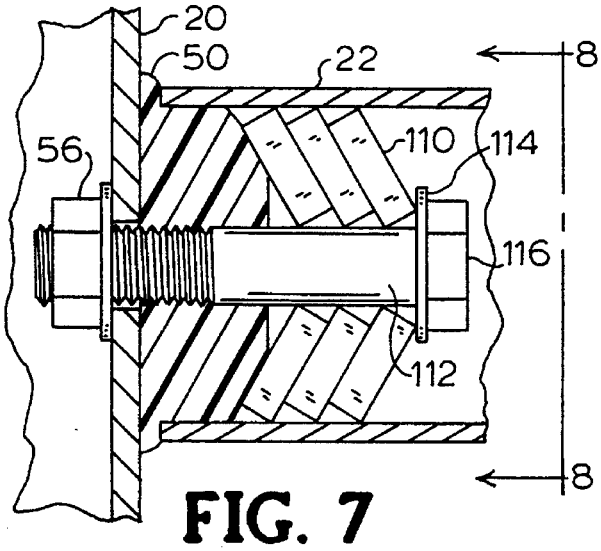
FIG. 7 is a partial cross sectional view showing another way to hold a rail to the barrier member.
Figure 8:
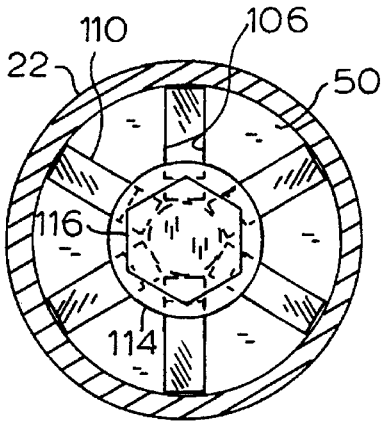
FIG. 8 is a cross sectional view taken along line 8—8 of FIG. 7.

FIGS. 7 and 8 show in cross section another alternative embodiment for holding the guardrail 22 to a barrier 20. The purpose of this embodiment is to obviate the long shaft 54 (FIG. 1) and the long tube 100 (FIG. 6). The whole idea is to grip the inside of each end of the guardrail 22. In this embodiment, the plug 50 is shaped with preferably six slots 106 (see FIG. 8) extending axially part way from the end of the plug 50 that is inside of the guardrail 22. At least one (but preferably three) hard steel slugs 110 are placed into each slot 106. The slugs 110 are long enough so that they will always be at an acute angle with respect to the axis of the guardrail 22. An inner edge of each slug bears against the unthreaded portion of a bolt 112 that extends out through the end of the guardrail 22 and the plug 50 and into the interior of the barrier 20. The slots 106 are just a bit smaller than the width of the slugs 110 so as to frictionally capture and hold the slugs in place.

At the assembly or job site, the slugs 110 are pressed into the slots in the plug 50, around the bolt 112, to form a subassembly. That subassembly is then pushed into the end of the guardrail 22, with the bolt 112 loosely in place or even pushed slightly into the plug 50 so as not to cause the slugs 110 to bind as they are eased into the end of the guardrail 22. When the plug 50 is as far into the end of the guardrail 22 as it should go, the bolt 112 is pulled tight to set the slugs, as shown in FIG. 7, into engagement with both the inside of the guardrail 22 and the unthreaded portion of the bolt 112. The bolt 112 can still be pushed in and out slightly to allow easy assembly of the guardrail 22 to the barrier 20.

When in place between two barriers 20, the threaded end of the bolt 112 is pulled into the interior of the barrier 20 and the nut 56 is threaded onto the bolt 112. The bite of the slugs 110 against the bolt 112 keeps it from rotating while the nut 56 is tightened, drawing a washer 114 on the head 116 of the bolt 112 against the slugs 110, wedging them into place, which causes the slugs 110 to bite into the interior surface of the guardrail 22 which prevents their axial movement out of the guardrail 22. If the bolt initially tends to rotate with the nut 56, a screwdriver slot can be formed at the threaded end of the bolt 112 to enable the assembler to keep the bolt 112 from rotating until the wedging action of the slugs 110 comes into play to apply great gripping force on the bolt 112.

The slugs 110 are preferably inexpensive, rectangular chunks of steel. While not fully shown in FIG. 7, the edges of the slugs 110 are not curved but are squared off, as more nearly illustrated in FIG. 8, where the slugs 110 meet the inside surface of the guardrail 22. Therefore, each slug 110 actually meets that inside surface of the guardrail 22 only at two points. Similarly, each slug 110 actually meets the unthreaded portion of the bolt 112 at only one point.

The inside diameter of the guardrail 22, the unthreaded portion of the bolt 112 and the slugs 110 are all sized such that the slugs 110 are all oriented much as shown in FIG. 7, whether tighten into place or Just barely touching each other. Each slug 110 touches the inside of the guardrail 22 at one of its edges. That slug 110 also touches the unthreaded portion of the bolt 112 at the diagonally opposite edge of the slug 110 (see FIG. 7). Once installed in the guardrail 22, an imaginary diagonal line along the side of the slug 110 that extends between those two diagonally opposite edges should never be allowed to be perpendicular to the axis of the guardrail 22. That imaginary diagonal line should preferably be about ten degrees from the perpendicular.

While a pipe is an inexpensive and convenient structure for the guardrail 22, it will be evident that tubing of square or rectangular or any other suitable cross section can be equivalently used. Also, it will be evident that the ends of the guardrail 22 can be either squared off or can be curved on top and bottom to define a more uniform spacing between the ends of the guardrail 22 and the outside of the upright barrier 20.

While not specifically illustrated in FIGS. 6, 7, and 8, it will be evident to one skilled in the art that an equivalent of the clamping means shown in those three figures could strongly expand the portion of the urethane plug or gasket 50 within the inside of the guardrail 22 so as firmly to grip by friction the inside of the guardrail 22. For example, a frustoconical, 3-D wedge nut at the end of the plug 50 inside of the guardrail 22 could be internally threaded to cooperate with the threads of the bolt 102 so as to press inwardly at that inside end of the plug 50 as the bolt 102 is tightened, thereby tending strongly to expand that inside end of the plug 50 as well as biasing outwardly the entire length of the plug 50 within the guardrail 22. It may even be useful to either insert or mold into the plug 50 a second frustoconical wedge, with a clearance hole to accommodate the bolt 102. That second frustoconical wedge could be arranged in the reverse direction from the first wedge and located at or near the end of the plug 50 that is nearest to the upright barrier 20. The result would be even stronger expansion and pressing by the plug 50 on the inside surface of the guardrail 22.

The inside of the guardrail 22 can be coated with epoxy or other material to enhance the frictional grip of the elastomeric or urethane plug 50 on the inside of the guardrail 22. As an alternative, the resilient elastomeric plug 50 can even be bonded to the inside of the guardrail 22.

In order to enhance the resilience of the mounting of the guardrail 22 to the upright barrier 20, the clearance hole formed in the upright barrier 20 in order to accommodate the bolt 102 can be made larger than the minimum size necessary to accommodate the bolt 102. Then an elastomeric, eg., urethane, spacer can be placed in the bolt clearance hole, around the bolt 102 and between the head of the bolt 102 and the inside of the upright barrier 20.

It will be evident to one skilled in the applicable art that all of the embodiments disclosed for attaching the rail member or guardrail 22 to the upright support member or barrier 20 constitute some form of clamp for squeezing the resilient gasket or plug 50 between the guardrail 22 and the barrier 20.

While a resiliently-mounted upright barrier 20 has been disclosed herein with respect to a plurality of guardrails 22 between adjacent upright barriers, it will be recognized that one or more guardrails 20 could be installed in a free-standing condition, without any guardrails 22 between them. Also, any number of guardrails 22 can be used, besides the two shown.

LIGHTWEIGHT EMBODIMENT

Referring now to FIG. 9, a lightweight resilient barrier support is shown for such uses as resiliently supporting hand railings along a pedestrian concourse or other passageway. A post 120 extends up from the area of the floor or base 122 which can be concrete or other material as in the case of the base 30 of FIG. 1. A base plate 124 rests on a resilient isolator pad 126, thereby locating the base plate 124 slightly above the base 122.

The base plate 124 and the isolator 126 have a central hole at least large enough to accommodate a stud 128 that is firmly anchored into the base 122. A nut 130 is threaded onto the stud 128 and is tightened to bear down on a steel washer 132 which in turn bears down on a resilient washer 134 (not shown in section) that presses the base plate 124 onto the isolator 126 and holds the base plate 124 firmly but with a slight resilience over the base 122.

The central hole in the base plate 124 is preferably somewhat larger than necessary to accommodate the stud 128. A portion of the resilient isolator 126 extends up through the central hole in the base plate 124, between the material of the base plate 124 and the stud 128 for resiliently locating the base plate 124 laterally with respect to the stud 128. The use of the resilient isolator pad 126 and the resilient washer 134 allow a little bit of impact-absorbing movement of the base plate 124 and with it the post 120, but not enough movement for purposes of the present invention.

Four square holes placed at 90-degree positions about the base plate 124 accept and hold four carriage-type bolts 138 that extend upward from the base plate 124. A thick, resilient urethane block or bushing 140 (not shown in section), of preferably about 90–95 durometer stiffness, is placed around each of the four bolts 138 and on top of the base plate 124. A post support plate 142 (see FIGS. 10 and 11) rests on top of the four bushings 140, with the four bolts 138 extending through four holes 144 in four ears 146 on the support plate 140. A nut 148 is threaded onto each of the four bolts 138 and tightened down to squeeze the resilient bushings 140 between the support plate 142 and the base plate 124. It will be evident to one skilled in the art that a single, large resilient urethane block having the necessary four holes therein can be used in place of the four bushings 140.

The ears 146 on the support plate 142 are all in the same plane (see FIG. 11). The support plate 142 has a large central hole 150 large enough to accommodate the outside diameter of the post 120. There are four webs 152 between the four ears 146 (see FIGS. 10 and 11). The webs 152 are twisted so as to expose a slightly curved, interior surface that preferably engages the exterior of the post 120 (see FIG. 9). There is a hole 154 in each web 152. As shown in FIGS. 9 and 10, four bolts 156 extend through the holes 154 in the webs 152 and through matching holes in the post 120—a fragment of which is shown in cross section in FIG. 10—and are threaded into square nuts 158 on the inside of the post 120. The post 120, with the bolts 156 and the nuts 158, are preferably assembled to the support plate 142 before putting the support plate on the four bushings 140.

Preferably, the support plate 142 and the post 120 can be bolted together at the factory. However, if they are to be shipped separately to the installation site, preferably, there is a slight interference or press fit between the large central hole 150 and the outside diameter of the post 120. The interference fit should be loose enough to allow easy on-site assembly to bring the bottom of the support plate 142 even with the bottom of the post 120 by light tapping with a mallet or tapping of the post and plate on the base 122. However, the interference fit should be tight enough to hold the plate 142 tightly enough to the post 120 so that four holes can be drilled in the post 120 in direct alignment with the holes 154 in the webs 152, using the holes 154 as guides for free-hand drilling.

If the material of the support plate 142 is too thick for easy forming or for cost and scrap saving on low-volume production, the support plate 142 can be fabricated from four pieces of thinner strip that would then be spot welded together. For example, each strip would be the width of the ear 146. Each strip would be twisted (and holes punched) to form a single web 152 in the center with an ear 146 on each end. The two ears 146 would be 90 degrees apart, and the two ears would be offset by the thickness of the material. After electroplating for corrosion resistance, four such strips would be arranged in a spot welding jig. The web 152 of each strip would be 90 degrees away from its neighbor and the offset ears 146 from adjacent webs 152 would overlap. For example, the ear from the web to the right would be above and would overlap the ear from the web on the left, in each case. Then, the ears would be spot welded to the extent necessary in order to achieve the desired cantilever beam strength of each ear 146.

In order to get the post 120 to stand vertically or plumb, the nuts 148 are selectively tightened to bias the support plate 142 in two directions.

A dust cover 160 of urethane or some other type of rubber can be snapped over the entire structure shown in FIG. 9, extending from the post 120 to the base 122, using a groove molded into the lower, inner edge of the dust cover 160 to cooperate with a corner or ridge molded onto the periphery of the resilient isolator 126 to hold the dust cover 160 in place.

While this embodiment of the present invention is referred to as the "lightweight" embodiment, its size can be scaled up or down to almost any extent. Besides hand railings, the lightweight embodiment can be used to mount such diverse things as partitions and room dividers, turnstiles, wire fencing, time clocks and time card racks, signs of all kinds, parking meters, etc., etc.

IMPROVED RESILIENT RAIL CLAMPING

Figure 12:
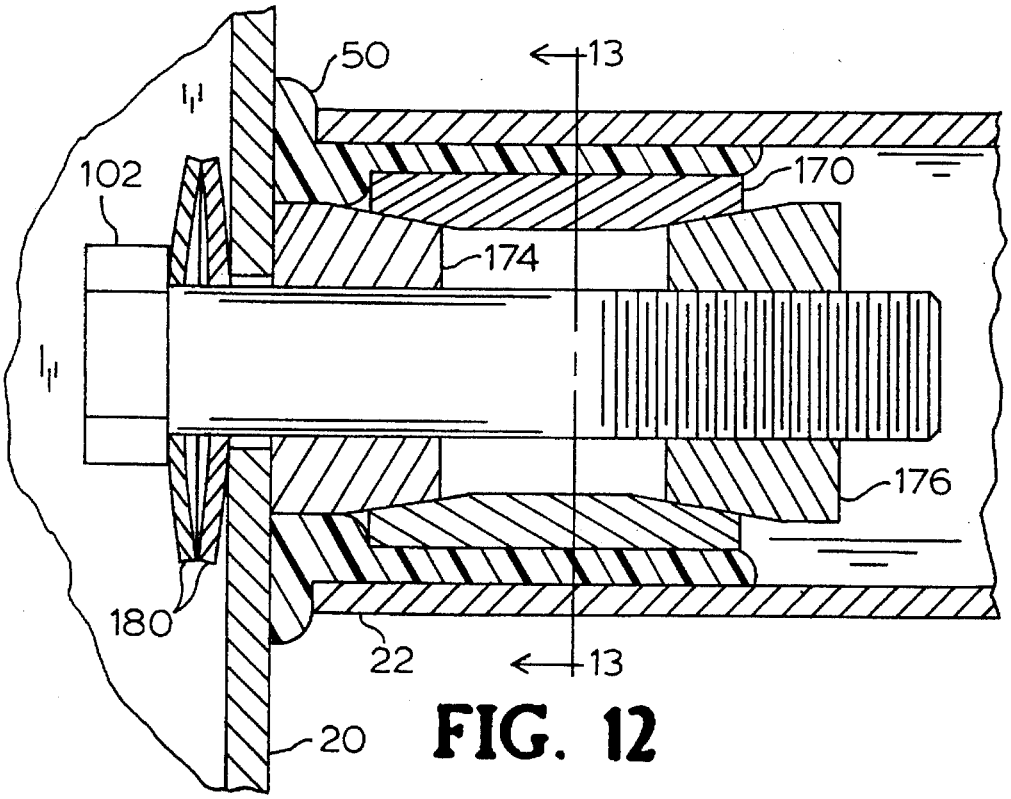
FIG. 12 is a partial cross sectional view showing yet another way to hold a rail to a barrier member.

Referring now to FIG. 12, there is shown a preferred embodiment for resiliently mounting the rail 22 to the upright barrier 20. A resilient member 50 which is generally similar to the elastomeric or urethane plug 50 of FIG. 6. The resilient member 50 also fits inside of one end of the guardrail 22 but is generally of thinner cross section than shown in FIG. 6, in order to provide a larger inside dimension. The resilient member 50 of FIG. 12, also generally like the elastomeric or urethane plug 50 of FIG. 6, has an enlarged end portion which fits between the end of the rail 22 and the upright barrier 20.

Since the rail 22 is preferably of steel pipe with a circular cross section, the outside of the resilient member 50 is also of circular cross section, at least where it fits inside of the rail 22. However, other materials cross sections are also suitable for the rail, depending upon cost and the nature of the service environment. While the upright barrier is preferably resiliently mounted as shown in FIG. 1, it is possible, but not usually recommended, that the upright barrier might actually be a wall or other member generally perpendicular to the length of the rail 22. However, if the upright member 20 is rigidly mounted, the efficacy and robustness of the rail and its mounting might be reduced.

A plurality of preferably-flat slugs 170 are spaced around the inside of resilient member 50 and may actually be molded in place on the inside of the resilient member. The inside end of each slug 170 is beveled to constitute a form of wedge or cam follower. A bolt 102 extends through a hole in the side of the upright barrier 20 and through the inside of the resilient member 50.

Since there are preferably six slugs 170, a pair of hexagonal wedges 174 (on the left as viewed in FIG. 12) and 176 (on the right) are placed with their six angled, outer surfaces bearing against the beveled surface at each end of the six slugs 170. Therefore, as the hexagonal wedges 174 and 176 move together, they cam the slugs apart and outwardly against the inside of the resilient member 50 and the rail 22.

The wedge 174, as viewed in FIG. 12, has a central hole of sufficient diameter to clear the bolt 102 without binding it in any way. The lefthand end of the wedge 174 bears against the outside surface of the upright barrier 20. The wedge 176 has a central hole that is threaded to the same size and pitch as the bolt 102 so that rotation of the bolt moves the wedge 176 to the left, as viewed in FIG. 12 and toward the wedge 174.

The bolt 102 has a hexagonal head that is accessible from the inside of the upright barrier 20. Therefore, as the bolt 102 is rotated so as to pull the wedges 174 and 176 together, the outwardly-expanding slugs 170 squeeze the resilient member 50 against the inside of the rail 22, holding it in place, in a radial direction with respect to the bolt 102.

Since the wedge 174 is stationary, against the side of the upright barrier and the wedge 176 moves to the left in FIG. 12, as it tightens against the resilient member 50, the slugs 170 move to the left, as viewed in FIG. 12, at about one-half the rate of movement of the wedge 176. As the slugs 170 are thus squeezed against the inside of the rail 22 and moved to the left, they tension the rail 22 against the upright barrier 20 and another upright barrier at the other end of the rail. This also tends to squeeze and deform the resilient material, generally as suggested in FIG. 12.

Two cupped spring washers 180, similar to the spring washers 38 of FIG. 1, are placed between the head of the bolt 102 and the inside of the upright barrier 20 in order further to tension the bolt 102 and add flexibility and resilience to the mounting of the rail 22 to upright barrier 20.

Figure 13:
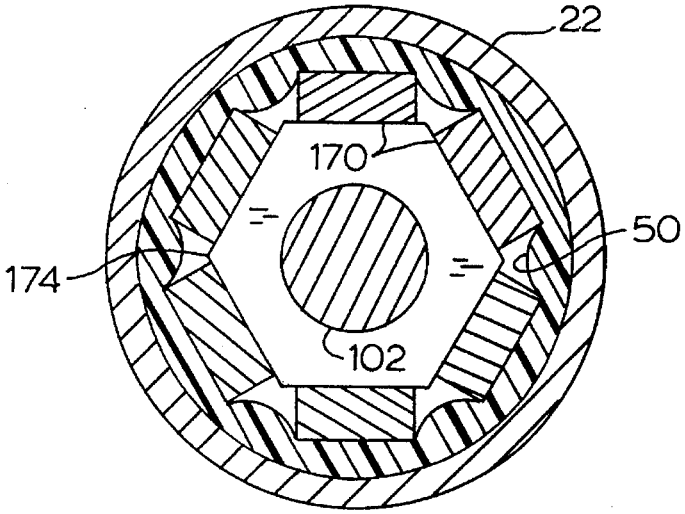
FIG. 13 is a view in cross section, taken along line 13—13 of FIG. 12.

Referring now to FIG. 13, the cross sectional view is taken between the two wedges 174 and 176, looking toward the left and wedge 174. The six sides of the wedge 174 are shown pushing the beveled ends of the six slugs 170 to press them against the inside surface of the resilient member 50. The outside surface of the resilient member 50 then presses against the inside surface of the rail 22.

Figure 14:
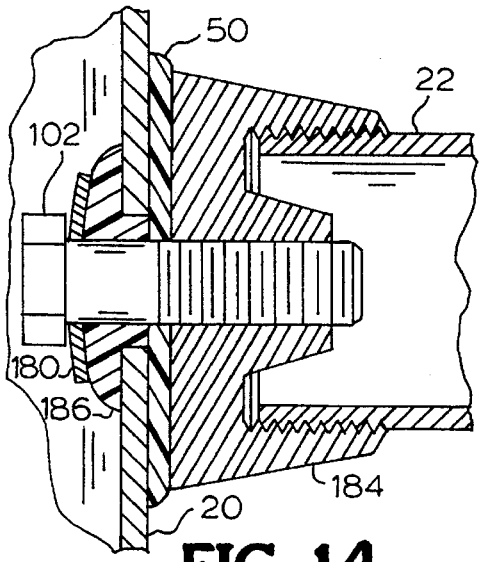
FIG. 14 is a cross sectional view showing still another way to hold a rail to a barrier member.

Referring now to FIG. 14, the end of the guardrail 22 can be threaded and screwed into a collar 184 which is preferably made of steel. The collar 184 has a curved back (not shown in FIG. 14) and is placed against the barrier member 20. A resilient member 50 (generally washer shaped) is positioned between the collar 184 and the barrier member 20 in order to allow shock-absorbing relative movement between the guardrail 22 and the upright barrier member 20. The resilient member 50 is preferably made of urethane.

A bolt 102 passes through an oversize hole in the barrier member 20 and is threaded into the collar 84. A resilient plug 186 is placed around the shank of the bolt 102 and between the head of the bolt 102 and the inside of the barrier member 20. The plug 186 also extends into and generally fills the annulus between the bolt and the perimeter of the oversize hole in the barrier member 20. The plug 186 is also made preferably of urethane and generally lets the bolt 102 move with the collar 184 so as to absorb shock delivered to the guardrail 22, without bending metal parts beyond their elastic limit.

A spring washer 180 between the bolt and the plug 86 controls the amount of force pulling the collar 184 to the barrier member 20 and also protects the top of the plug 186 (the left side, as viewed in FIG. 14) from the bottom (the right side, viewed in FIG. 14) of the head of the bolt 102 during tightening and shock-absorbing displacement. Otherwise, the bottom of the bolt 102 might damage the top of the plug 186 during tightening and shock absorption, possibly causing premature failure. While only one spring washer 180 is shown in FIG. 14, several such spring washers might be used at that location.

Figure 15:
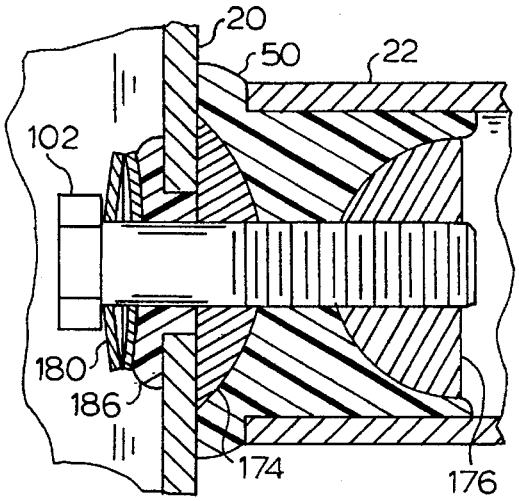
FIG. 15 is a cross sectional view showing yet another way to hold a rail to a barrier member.

Referring now to FIG. 15, there is shown a variation on the guardrail holding embodiment of FIGS. 12 and 13. The hexagonal wedges 174 and 176 are replaced with domed members 174 and 176, respectively. However, rather than bear against slugs 170 (as in FIGS. 12 and 13, the domed members 174 and 176 of FIG. 15 bear directly against the portion of the resilient member 50 that extends into the guardrail 22.

The domed members 174 and 176 in FIG. 15 serve much the same purpose as the hexagonal wedges 174 and 176 of FIGS. 12 and 13. That is, when the bolt 102 is tightened, the internally-threaded domed member 176 is moved to the left, as shown in FIG,, 15. Meanwhile, the domed member 174 stays pressed against the barrier member 20 and can not move. Therefore, as the two domed members 174 and 176 come closer together, they displace the portion of the resilient member 50 between them and cause the resilient member 50 to press against the inside surface of the guardrail 22. This resiliently holds the guardrail 22 against the upright barrier member 20.

A resilient plug 186 is also shown in FIG. 15 and serves the same function here as it serves in the embodiment of FIG. 14. Here, two spring washers 180 are shown; however, as with FIG. 14, any number of spring washers can be used as may be deemed expedient.

Figure 16:
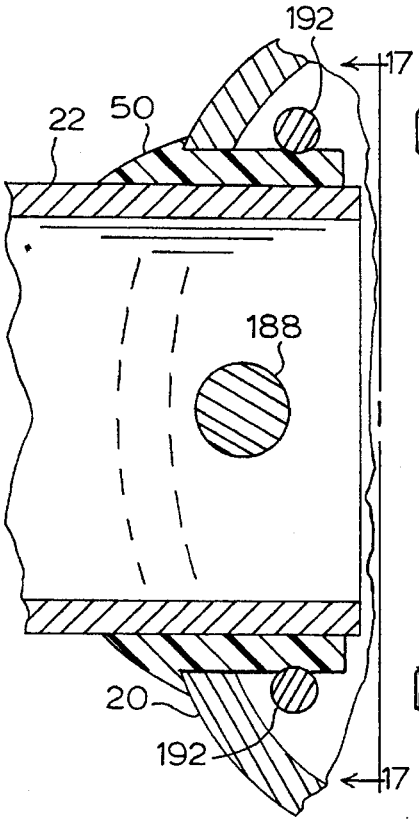
FIG. 16 is a cross sectional view, taken along lines 16—16 of FIG. 17, showing still yet another way to hold a rail to a barrier member.
Figure 17:
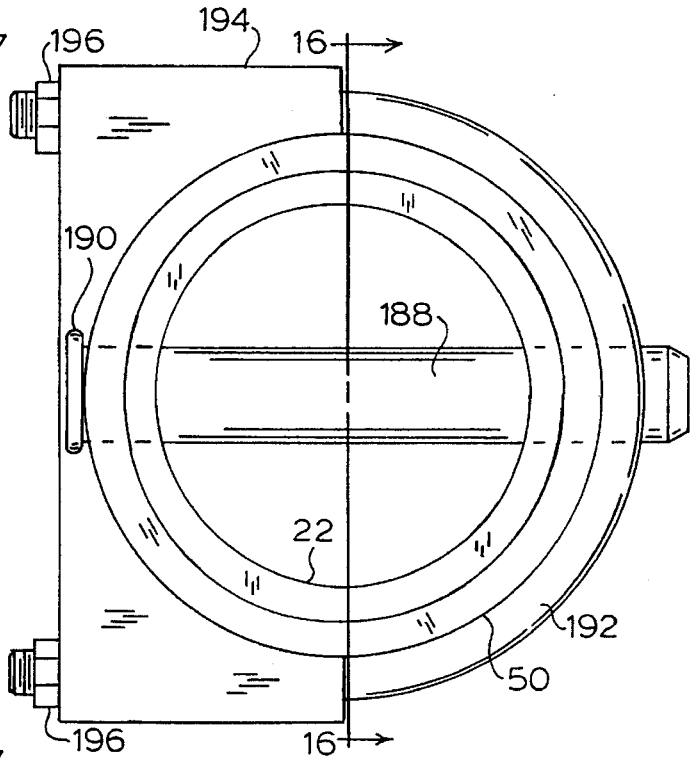
FIG. 17 is a cross sectional view, taken along lines 17—17 of FIG. 16, showing how the end of a rail and its attachment to a barrier member would look from inside of the barrier member.

Referring now to FIGS. 16 and 17, still yet another embodiment of the present invention is shown in which the guardrail 22 is longer than the closest distance between two adjacent upright barrier members 20, or some other upright support for the guardrails. As shown in partial cross section in FIG. 16, the guardrail 22 extends through and into the inside of the barrier member 20. A resilient member 50 is placed between the guardrail 22 and the upright barrier member 20 to cushion an impact to the guardrail 22 as that impact is transmitted to the supporting barrier member 20. The resilient member 50 is preferably of urethane.

a U-bolt clamp 192, generally of the type used to clamp the components of an automotive exhaust system, but preferably somewhat larger, is used to assure that the resilient member 50 is held tightly to the guardrail 22 and to assure that the end of the guardrail 22 does not slip out of the hole in the side of the barrier member 20. Referring now to FIG. 17, the end of the guardrail 22 is shown, as it would appear when viewed from the inside of the barrier member. An arcuate collar 194 completes the clamping circle around the resilient member 50, and is drawn tight by tightening two nuts 196.

Alternatively, a bolt or pin 188 passes through holes in the guardrail 22 and perhaps the resilient member 50. The pin 188 is long enough to prevent the guardrail 22 from slipping out of the barrier member 20. However, the pin 188 is recessed far enough inside of the inside surface of the barrier member 20 so that slight longitudinal movement of the guardrail 22 is possible within the opening in the barrier member 20, through which the guardrail extends. A head 190 (see FIG. 17), of slightly larger diameter than the diameter of the pin 188, keeps the pin, which is inserted from the top, from falling through and out of the guardrail. The slight clearance between the pin and the inside surface of the barrier member 20 also allows the guardrail 22 to bend, within its elastic limit, and slightly foreshorten in the event of an impact, without tending to pull together the two barrier members 20 which support the guardrail. If no impact is anticipated that would tend to exceed the elastic limit of the guardrail 22, the resilient member 50 may be omitted, just so long as the guardrail 22 can still move inside the hole in the barrier 22, so as to continue to be resiliently mounted; however, this is not preferred.

Preferably, if a bolt or pin 188 is used to prevent the guardrail 22 from falling out of the barrier member 20, a shorter resilient member 50 can be used, which does not extend quite so far into the inside of the barrier member 20. Such a shorter resilient member 50 would preferably have a ridge (not shown) extending outwardly from its inner end, in order to prevent the resilient member 50 from slipping out of the hole in the barrier member 20. However, the resilient member could still be squeezed into the hole in the barrier member so that the ridge would be on the inside of the barrier member. Once the guardrail 22 has been slid through the inside of the resilient member 50, the ridge would not be able to pass through the hole in the barrier member 20, thereby locking the resilient member into place.

If a bolt or pin 188 is used to keep the end of the guardrail 22 within the upright barrier member 20, the resilient member 50 of FIGS. 16 and 17 is preferably molded to an arcuate shape to match the shape of the hole in the upright barrier member 20. Therefore, as viewed in FIG. 16, the bolt or pin 188 would be wholly inside of the molded inner end of the resilient member 50, rather than passing through a hole in the resilient member 50, as suggested by FIG. 16. Consequently, the head 190 of the pin 188 (or a bolt) would rest on the outside surface of the guardrail 22, not the outside surface of the resilient member 50, as is shown in FIG. 17.

Since the guardrail 22 might rotate in the hole in the upright barrier member 20, the pin can conventionally be retained in the guardrail 22 by a spring ring (or equivalent) in a groove (neither of which are shown in FIG. 17) at the end of the pin 188 opposite to the head 190. If a bolt is used instead of the pin 188, a nut (not shown) would hold the bolt 188 from falling out of the hold in the guardrail 22. In either case, resilient sleeves (not shown) are preferably placed around both ends of the pin or bolt 188, where they contact their clearance holes in the guardrail 22.

The bolt or pin 188 and the nuts 196 of the U-bolt clam 192 are shown in FIG. 17 to be on the left side of the guardrail 22. However, such an orientation is only to enable easy visual correlation to the corresponding parts of FIG. 16, which is how the parts would normally be viewed from the top of the upright barrier member 20. The head 190 of the pin 188 and the nuts 196 would normally be positioned on top of the portion of the guardrail 22 that extends into the inside of the barrier member 20.

While the form of apparatus herein described constitutes a preferred embodiment of this invention, it is to be understood that the invention is not limited to this precise form of apparatus, and that changes may be made therein without departing from the scope of the invention which is defined in the appended claims.

I claim:

1. A resilient safety barrier with a barrier member having an end that is resiliently supported on the surface of a base, comprising:

a block of resilient material for flexibly supporting the end of the barrier member on the base and having:

a shape approximating that of the end of the member, a perimeter approximately the size of the barrier member, with the end of the barrier member supported by the block of resilient material at substantially the perimeter of the block of resilient material, and a surface by which the block rests on the base;

a resilient fastener for biasing the barrier member and the block of resilient material toward the base, so as to allow limited, non-destructive, shock-absorbent movement of the barrier member with respect to the base;

at least one rail extending from the member to another, similar member; and means for resiliently mounting the rail to the barrier members.

2. A resilient safety barrier according to claim 1 wherein said means for resiliently mounting the rail comprises:

a resilient gasket located between the rail and the member, so as to allow limited, non-destructive, shock-absorbent movement of the rail relative to the member; and means for holding the gasket between the rail and the member.

3. A resilient safety barrier according to claim 2 wherein said holding means comprises:

a rod having two threaded ends, with said ends extending through both barrier members;

the rod extending through the length of the rail; and a threaded fastener in engagement with and tightened upon each threaded end of the rod.

4. A resilient safety barrier according to claim 2 wherein the rail has an inside surface and an outside surface, said holding means comprises:

a threaded member extending through the gasket;

a plurality of slugs angularly mounted between the inside surface of the rail and the threaded member; and means for tensioning the threaded member so as to force the slugs to grip the inside surface of the rail, thus drawing the rail toward the barrier, thus squeezing the gasket between the rail and the barrier.

5. A resilient mounting for a barrier rail, comprising:

at least two support members for supporting the rail;

a rail member extending substantially between the two support members;

a resilient gasket located between the rail member and each support member, so as to allow limited, non-destructive, shock-absorbent movement of the rail member relative to the support member;

means for holding the resilient gasket between the rail member and the support member;

said resilient gasket comprises resilient material extending along a portion of the inside of the rail member; and said means for holding comprises means for applying force in an outward direction against the resilient material on the inside of the rail member and for applying force in a direction along the length of the rail member.

6. A resilient mounting according to claim 5 wherein said force-applying means comprises:

at least one camming segment positioned against the resilient material along the inside of the rail member; and cam means bearing against the camming segment for camming said camming segment in an outward direction by moving in the direction along the length of the rail member.

7. A resilient mounting according to claim 6 wherein:

a plurality of camming segments are positioned against the resilient material along the inside of the rail member; and said cam means has a plurality of cam surfaces, equal in number to the number of camming segments, for bearing against the camming segments, thereby pushing the camming segments outwardly against the resilient material and simultaneously biasing the camming segments in a direction along the length of the rail member.

8. A resilient mounting according to claim 7 wherein said cam means comprises:

a threaded member having sloping external sides and a threaded internal portion; and a bolt extending from a support member and threaded into the threaded internal portion of the threaded member, whereby relative rotation of the bolt and the threaded member causes the threaded member to move in a direction along the length of the rail member and so as to bias the camming segments, thereby biasing the camming segments outwardly against the resilient material and also along the length of the rail member.

9. A resilient mounting according to claim 5 wherein the force-applying means comprises:

an outwardly-flared, internally-threaded member positioned to bias the resilient material outward when moved in a direction along the length of the rail member; and a bolt extending from a support member and threaded into the internally-threaded portion of the threaded member, whereby relative rotation of the bolt and the threaded member causes the threaded member to move in a direction along the length of the rail member, thereby biasing the resilient material both in an outward direction and along the length of the rail member.

10. A resilient mounting for a guardrail comprising:

at least two support members;

a rail member extending substantially between the two support members;

a resilient member at each end of the rail member and separating the rail member from each support member; and means for squeezing the resilient member against the rail member and for drawing the resilient member toward the support member, and frictionally drawing the associated end of the rail member with it.

11. A resilient mounting for a guardrail comprising:

at least two support members;

a rail member extending substantially between the two support members;

a resilient member at each end of the rail member and separating the rail member from each support member; and means for clamping the resilient member to the rail member.

12. A resilient mounting for a guardrail according to claim 11, wherein:

the rail member is circular in cross section;

the resilient member is circular in cross section and located beyond but in contact with the outside diameter of the rail member; and the clamping means comprises a circular clamp squeezing the resilient member onto the outside diameter of the rail member, said clamping means extending substantially beyond the outside diameter of the resilient member so as to prevent longitudinal movement of the rail member in at least one direction outside of engagement with the support member.

* * * * *

UNITED STATES PATENT AND TRADEMARK OFFICE

CERTIFICATE OF CORRECTION

PATENT NO. : 5,566,926

DATED : October 22, 1996

INVENTOR(S) : William L. Voigt

It is certified that error appears in the above-indentified patent and that said Letters Patent is hereby corrected as shown below:

On the cover page, line [73], the Assignee:
change "Voight Products Incorporated" to
--Voigt Products Incorporated--

Signed and Sealed this

Sixth Day of May, 1997

*Attest:*

BRUCE LEHMAN

*Attesting Officer*

*Commissioner of Patents and Trademarks*